US005533240A

United States Patent [19]

Murai

[11] Patent Number: 5,533,240

[45] Date of Patent: Jul. 9, 1996

[54] LOCK FASTENER

[75] Inventor: Ryukichi Murai, Toyama, Japan

[73] Assignee: Yoshida Kogyo K.K., Tokyo, Japan

[21] Appl. No.: 170,795

[22] Filed: Dec. 21, 1993

[30] Foreign Application Priority Data

Dec. 22, 1992 [JP] Japan ..... 4-092326

[51] Int. Cl.[6] ..... A41F 1/00

[52] U.S. Cl. ..... 24/615; 24/633; 292/DIG. 38

[58] Field of Search ..... 292/137, 159, 292/DIG. 38, DIG. 48, DIG. 50; 24/614–616, 633, 588, 589, 627, 696

[56] References Cited

U.S. PATENT DOCUMENTS

| | | | |
|---|---|---|---|
| 4,023,839 | 5/1977 | Bisbing | 292/DIG. 38 X |
| 4,633,549 | 1/1987 | Lovato | 24/615 |
| 4,662,664 | 5/1987 | Wendt et al. | 292/DIG. 38 X |
| 4,679,282 | 7/1987 | Feng | 24/615 X |
| 4,802,262 | 2/1989 | Kasai | 24/615 X |
| 4,866,819 | 9/1989 | Kasai | 24/633 X |
| 4,945,614 | 8/1990 | Kasai | 24/615 X |
| 4,999,886 | 3/1991 | Kasai | 24/633 |
| 5,113,556 | 5/1992 | Murai et al. | 24/615 X |
| 5,193,707 | 3/1993 | Mizumura | 292/DIG. 48 X |

FOREIGN PATENT DOCUMENTS

| | | |
|---|---|---|
| 0044639 | 1/1982 | European Pat. Off. . |
| 0427525 | 5/1991 | European Pat. Off. . |
| 2565079 | 12/1985 | France . |
| 50-102706 | 8/1975 | Japan . |
| 61-25382 | 7/1986 | Japan . |

*Primary Examiner*—Steven N. Meyers
*Assistant Examiner*—Suzanne L. Dino
*Attorney, Agent, or Firm*—Hill, Steadman & Simpson

[57] ABSTRACT

A lock fastener for bags or other receptacles (B) comprises a plug member and a socket member releasably engageable therewith, the plug member having an engaging tongue which is resiliently lockable with the socket member and unlockable therefrom by a means movable toward and away from the plug member and resiliently retractable to its original position upon releasing the plug member 11 from the socket member 12.

3 Claims, 4 Drawing Sheets

LOCK FASTENER

BACKGROUND OF THE INVENTION

1. Field of the Invention

This invention relates to a lock-fastener for bags, briefcases or other receptacles adapted to be closed by a flap or cover thereon.

2. Prior Art

Most conventional lock fasteners basically comprise a female or socket member attached to the body of a bag and a male or plug member attached to flap and engageable with the socket member to close the flap over the bag. Inadvertently applied pressure to this type of lock fastener would sometimes cause separation of the plug member from the socket member, leading to an opened flap. Conversely, intended pressure to open the bag would often fail to unlock the fastener in the case where the bag is flat that is; not enough loaded, at might be experienced with lock fasteners of the type disclosed in Japanese Laid-Open Utility Model Publication No. 50-102706. To eliminate or alleviate such malfunctioning of the known devices, there have been introduced some improvements such as are taught in Japanese Patent Publication No. 61-25382 in which there is shown a lock fastener comprising a socket member having a guide chamber, a slide member movably supported in the chamber and having a retaining lug, and a plug member having an engaging tongue with an aperture dimensioned to receive the lug and adapted to move together with the slide member into and out of the chamber of the socket member. In this case, both hands of the user are required to register the aperture with the lug and thus join the engaging tongue with the slide member, which is literally tedious and time consuming. Another difficulty is that the engaging tongue can not make its way smoothly into and through the guide chamber of the socket member if the bag is loaded either too lightly or too heavily.

SUMMARY OF THE INVENTION

With the foregoing difficulties of the prior art devices in view, the present invention seeks to provide a lock fastener which incorporates means for maintaining easy, smooth normal operation of the fastener and means for ensuring freedom from unintentional unlocking of the fastener against inadvertent external pressure.

The above and other fastener and advantages of the invention will be better understood from the following detailed description taken in conjunction with the accompanying drawings, in which lake reference numerals refer to like or corresponding parts throughout the several views.

According to the invention, there is provided a lock fastener which comprises a plug member having a resilient engaging tongue flexibly movable about a transverse axis defined at one of its ends and a locking recess formed at the opposite end, a socket member having a guide chamber adapted to receive the engaging tongue, an anchoring bar extending transversely through the chamber and engageable with the locking recess to lock the plug member relative to the socket member and a pair of spaced resilient gripping fingers, and an unlocking means movable toward and away from the plug member and having a presser foot having tapering side walls engageable between the pair of gripping fingers, the presser foot being engageable with the engaging tongue to unlock the plug member from the socket member.

DETAILED DESCRIPTION OF THE INVENTION

Figure 1:
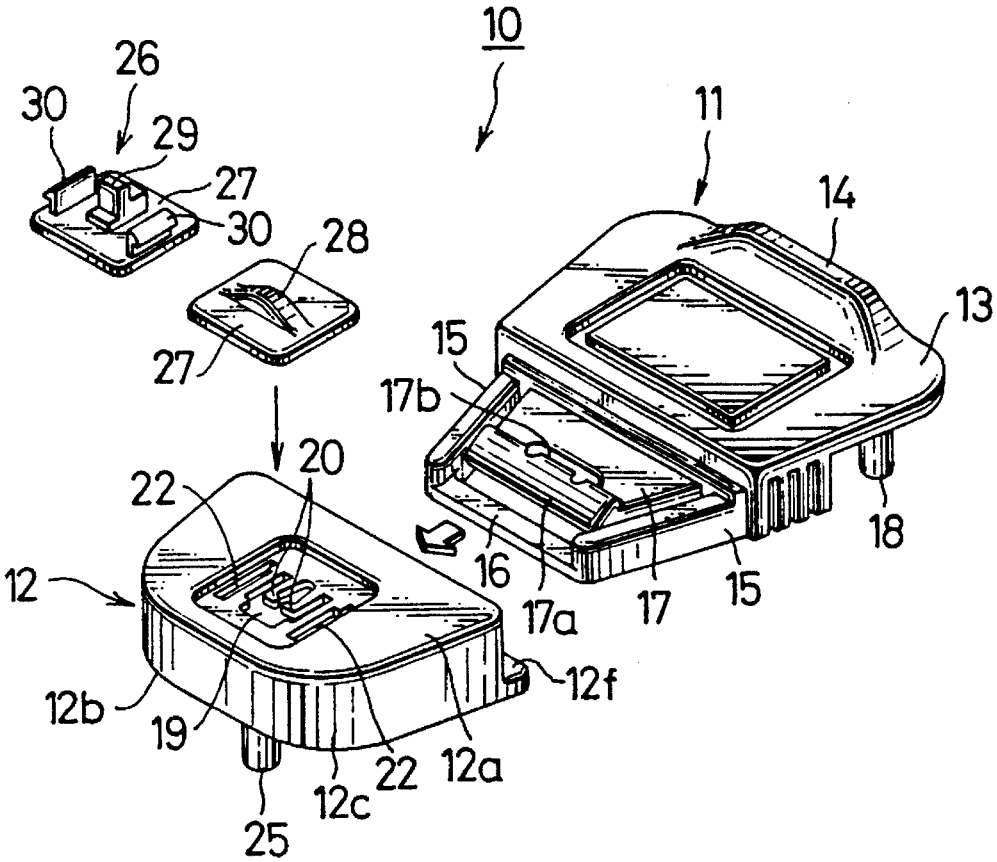
FIG. 1 is an exploded perspective view of a lock fastener embodying the invention.

Referring now to the drawings and FIG. 1 in particular, there are shown those component parts which constitute a lock fastener 10 embodying the invention. The lock fastener 10 essentially comprises a plug member 11 and a socket member 12 which respectively constitute a male and a female part of the fastener.

The plug member 11 has a generally rectangular body 13 including a handle portion 14 extending upwardly from one end of the body for manipulating movement of the plug member 11 toward and away from the socket member 12. Extending horizontally forwardly from the opposite end of the plug body 13 are a pair of tapering side flanges 15, 15 which are joined together by a connection bar 16.

Interposed between the side flanges 15, 15 is an engaging tongue 17 having one of its ends connected to formed integrally with an end wall of the plug body 13, while the other end adjacent the connecting bar 16 is held free such that the tongue 17 can move resiliently pivotally about a transverse axis defined at the said one end of the tongue 17. The free end of the engaging tongue 17 is thickened to provide a sloped guide surface **17*a* and an transversely extending offset locking recess 17*b* remote from the surface 17*a*** for purposes hereafter to be described.

Figure 9:
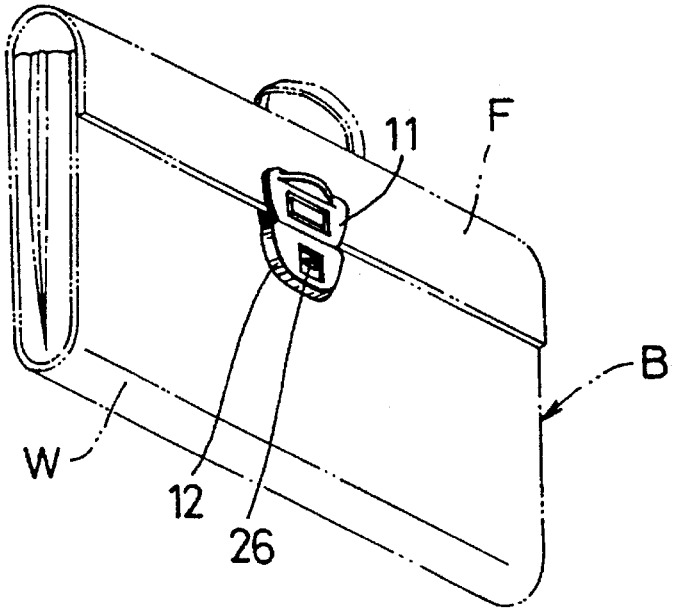
FIG. 9 is a perspective view of a briefcase to which the lock fastener of the invention is applied.

Designated at 18 is a connecting stud or studs extending downwardly from the plug body 13 adjacent to the handle portion 14 and adapted to secure the plug member 11 to a flap F of a brief case B (FIG. 9) in a manner well known in the art.

The socket member 12 is substantially in the form of a rectangular casing comprising an upper plate **12*a*, a lower plate 12*b* and a peripheral flange 12*c* which jointly define a guide chamber 12*d* dimensioned and configured to receive the engaging tongue 17 of the plug member 11. An inlet opening 12*e* is formed at one end of the socket member 12 in communication with the guide chamber 12*d* for passing therethrough the engaging tongue 17 into and out of the chamber 12*d*. The lower plate 12*b* of the socket member 12 is slightly forwardly extended to provide a guide porch 12*f* for facilitating the insertion of the engaging tongue 17 through the guide opening 12*e* into the guide chamber 12*d***.

Figure 2:
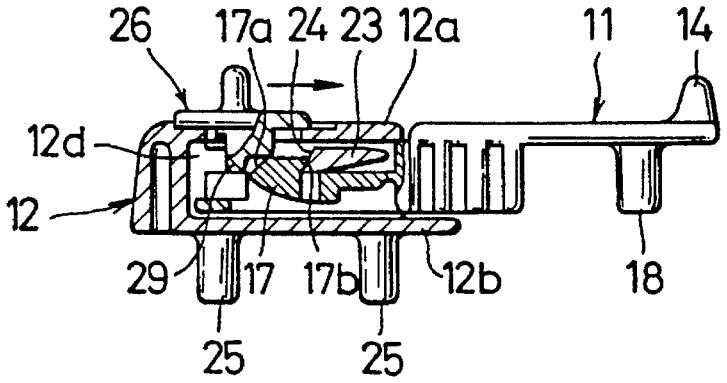
FIG. 2 is a longitudinal cross-sectional view, showing the lock fastener in locked position.
Figure 3:
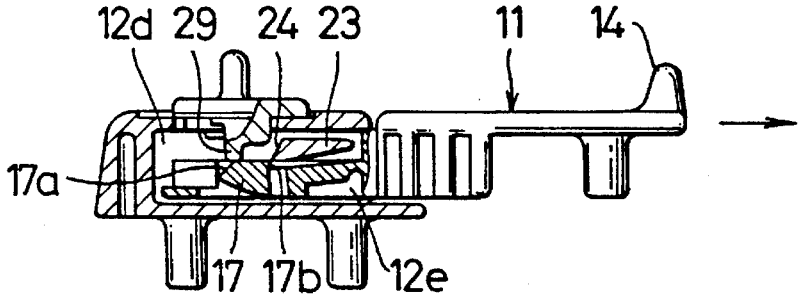
FIG. 3 is a view similar to FIG. 2 but showing the lock fastener in the process of being unlocked.
Figure 7:
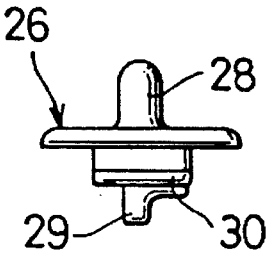
FIG. 7 is a side elevational view of the unlocking means.

The upper plate **12*a* of the socket member 12 is stamped or otherwise cut out to provide a polygonal through-aperture 19 accommodating therein a pair of spaced resilient gripping fingers 20, 20 having respective inwardly directed nails 21, 21 and further to provide a pair of elongated guide slits 22,22 formed on opposite sides of the aperture 19 and extending parallel with the gripping fingers 20, 20. An anchoring bar 23 extends transversely through the guide chamber 12***d* between opposite side walls of the peripheral flange 12*c* of the socket member 12 and has an angled. anchoring surface 24 disposed adjacent to a transverse line connecting respective one ends of the aperture 19 and the slits 22, 22 for relesably engaging the engaging tongue 17 of the plug member 11 as shown in FIGS. 2 and 3. Extending downwardly from the lower plate 12*b* of the socket member 12 are a pair of connecting studs 25, 25 with which to secure the socket member 12 to a front web W of the brief case B in a manner similar to the studs 18 of the plug member 11. Designated at 26 and better shown in FIGS. 7 and 8 is an unlocking means movable toward and away from the plug member 11 and comprising a base 27 having a gripping projection 28 formed on its upper surface.

Figure 8:
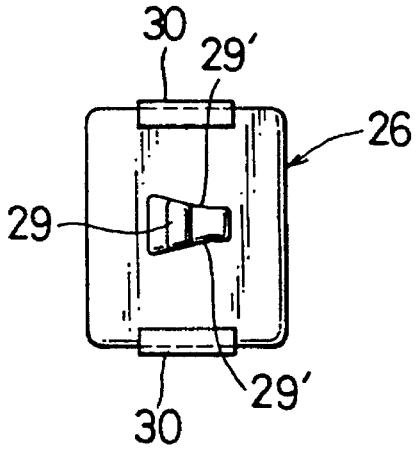
FIG. 8 is a bottom plan view of the same.

Extending downwardly centrally from the lower surface of the base 27 is a presser foot 29 which is releasably engageable through he aperture 19 of the socket member 12 with the engaging tongue 17 of the plug member 11 to lock the latter relative to the socket member 12 and which tapers off along its lateral side walls 29' toward the inlet opening 12*e* of the socket member 12 as better shown in FIG. 8.

At opposite side of the presser foot 29 are formed a pair of guide rails 30, 30 slidingly movable in and along the corresponding guide slits 22, 22 of the socket member 12.

The operation of the lock fastener 10 thus constructed will now be described with reference to FIGS. 2 through 6 inclusive.

Figure 5:
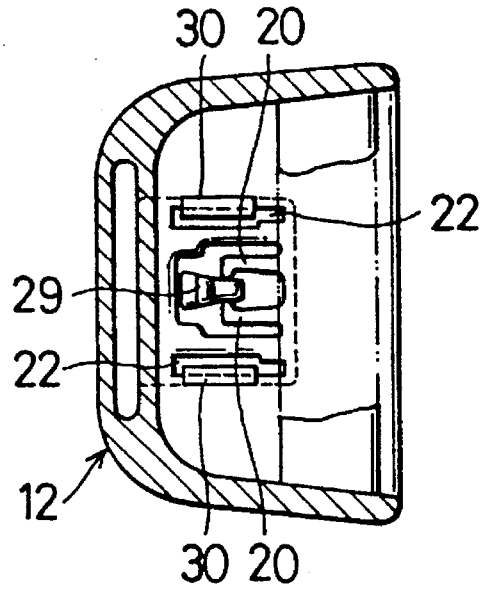
FIG. 5 is a sectional view utilized to explain the relationship between a socket member and an unlocking means when the lock fastener is in the position of FIG. 2.

Coupling of the plug member 11 with the socket member 12 is accomplished by inserting the engaging tongue 17 through the inlet opening 12*e* into the chamber 12*d* of the socket member 12, in which instance the tongue 17 initially bends down flexibly in contact with the anchoring bar 23 and then bounces back up when it is anchored in place with its locking recess 17*b* brought into abutting engagement with the angled anchoring surface 24 as shown in FIG. 2 corresponding to FIG. 5 which illustrates the relation between the unlocking means 26 and the socket member 12 when the latter is fully engaged with the plug member 11.

Figure 4:
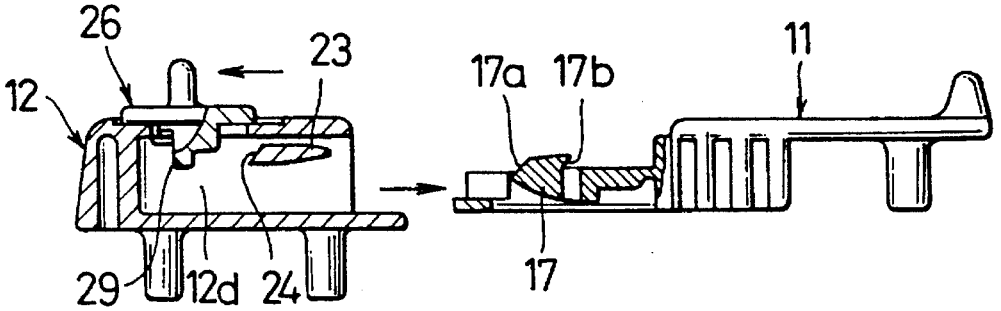
FIG. 4 is a longitudinal cross-sectional view, showing the lock fastener in separated position.
Figure 6:
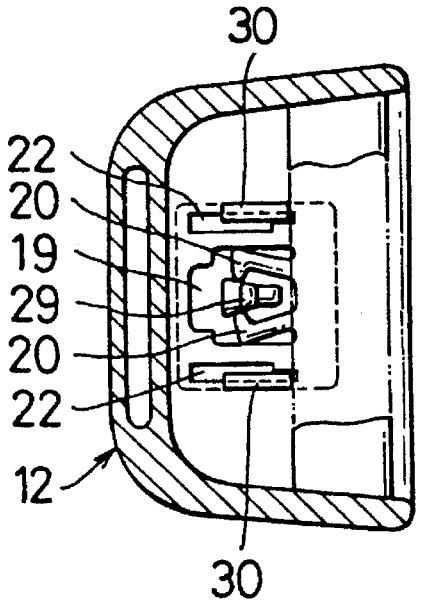
FIG. 6 is a view similar to FIG. 5 but showing the relationship of the socket member and the unlocking means when the lock fastener is in the position of FIG. 3.

Now, uncoupling or separation of the plug member 11 from the socket member 12 is accomplished by moving the unlocking means 26 with its gripping projection 28 towards the plug member 11, in which instance the presser foot 29 intrudes between and spreads the pair of the gripping fingers 20, 20 outwardly apart from each other while the guide rails 30, 30 slide along the guide slits 22, 22 until the presser foot 29 rides over the sloped surface 17*a* of the engaging tongue 17 and reaches near the top end of the latter, urging the tongue 17 to move downwardly or sink resiliently end thus releasing the anchoring bar 23 from the locking recess 17*b* as shown in FIGS. 3 and 6. In this position of the lock fastener 10, the plug member 11 is ready to be pulled out and separated from the socket member as illustrated in FIG. 4. Simultaneously as the plug member 11 is thus separated, the unlocking means 26 is automatically pushed back into the original retracted position shown in FIGS. 2 and 5 by means of a resilient action imparted to the presser foot 29 by the gripping fingers 20, 20 as the latter slide down the tapering side walls 29' of the presser foot 29 to restore their original parallel relative position shown in FIG. 3.

Obviously, various modifications and variations of the present invention are possible in the light of the above teaching. It is therefore to be understood that within the scope of the appended claims the invention may be practiced otherwise than are specifically described.

what is claimed is:

1. A lock fastener which comprises:

(a) a plug member having a resilient engaging tongue flexibly movable about a transverse axis defined at one of its ends and having a sloped guide surface and a locking recess formed in said tongue;

(b) a socket member having a guide chamber adapted to receive said engaging tongue, and a stationary anchoring bar extending transversely through said chamber and engageable with said locking recess to lock said plug member relative to said socket member; and (c) an unlocking means slidably movable along a direction parallel to a direction of insertion of said plug member into said socket member, toward and away from said plug member and having a presser foot slidably engageable with said sloped guide surface of said engaging tongue, along the direction parallel to the direction of insertion of said plug member into said socket member, to deflect said tongue away from said stationary anchoring bar to disengage said locking recess from said stationary anchoring bar to unbuckle said plug member from said socket member.

2. A lock fastener according to claim 1 wherein said socket member is provided with a pair of spaced resilient gripping fingers and said presser foot has tapering side walls engageable between said gripping fingers.

3. A lock fastener according to claim 2 wherein said socket member has a pair of elongated guide slits extending on opposite sides of said pair of gripping fingers and said unlocking means has a pair of guide rails movable along said guide slits.

* * * * *